United States Patent [19]

Hoffmann

[11] Patent Number: 4,771,143

[45] Date of Patent: Sep. 13, 1988

[54] DIAPHRAGM KEYBOARD

[75] Inventor: Horst Hoffmann, Glonn, Fed. Rep. of Germany

[73] Assignee: Wilhelm Ruf K.G., Munich, Fed. Rep. of Germany

[21] Appl. No.: 39,047

[22] Filed: Apr. 16, 1987

[30] Foreign Application Priority Data

Apr. 17, 1986 [DE] Fed. Rep. of Germany ..... 8610553

[51] Int. Cl.[4] ..... H01H 13/70

[52] U.S. Cl. ..... 200/159 B; 200/5 A

[58] Field of Search ..... 200/159 B, 5 A

[56] References Cited

U.S. PATENT DOCUMENTS 3,600,528 8/1971 Leposavic ..... 200/159 B
4,128,744 12/1978 Seeger ..... 200/5 A
4,375,585 3/1983 Lee ..... 200/159 B
4,489,227 12/1984 Lamarche ..... 200/159 B
4,580,018 4/1986 Yoshihara ..... 200/5 A

FOREIGN PATENT DOCUMENTS 2541523 8/1984 France ..... 200/159 B

*Primary Examiner*—Renee S. Luebke
*Attorney, Agent, or Firm*—Helfgott & Karas

[57] ABSTRACT

The diaphragm keyboard comprises a baseboard from the bottom of which pins (11) project in vertical direction. These pins (11) pass through apertures (22) in an encoding plate (20) and extend beyond the surface thereof, thus presenting spacers for a diaphragm (30). In addition, they serve for retaining and aligning the encoding plate (20).

15 Claims, 3 Drawing Sheets

DIAPHRAGM KEYBOARD

Figure 1:
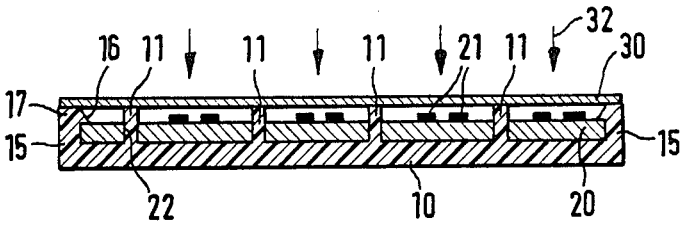

The instant invention relates to a diaphragm keyboard, comprising a baseboard, an encoding plate arranged on top of the baseboard and including electrical switch contact surfaces, and a flexible diaphragm which is arranged spaced from and opposed to the encoding plate and includes electrically conductive areas at least opposite the electrical switch contact surfaces.

Such a diaphragm keyboard is known from U.S. Pat. No. 4,365,130. Looking at it from the bottom to the top, its structure is as follows:

a baseboard of rather hard material, a thin layer of adhesive on top of it, and an encoding plate of flexible, electrically insulating material on top of the latter.

At its upper surface the encoding plate has electrical switch contact surfaces and conductor paths which are applied in conventional manner, such as by screen printing or etching and consist of copper, silver, or another conductive material. A spacing layer of electrically insulating material is arranged above the encoding plate, and this layer is formed with cutouts opposite the switch contact surfaces. On top of this there is a flexible diaphragm which has electrically conductive areas at its underside opposite the cutouts. Finally, there is a cover at the top and it again has recessed portions or cutouts opposite the switch contact surfaces.

An electrical contact is closed by pressing down the flexible diaphragm, for instance, by exerting pressure by a finger, whereby an electrically conductive area projects through the cutout in the spacing layer to touch a pair of corresponding switch contact surfaces on the encoding plate, thus establishing an electrical connection between the contact surfaces.

Similar diaphragm keyboards are known also from the publications below:

DE-OS No. 30 12 717

U.S. Pat. No. 4,405,849

U.S. Pat. No. 4,385,215.

It is expensive to use a separate spacing foil. On the one hand, an additional structural member must be produced and, on the other hand, this member must be aligned precisely when being mounted and fixed so that it will not become displaced during subsequent operation.

Thus it has been proposed already (cf. EP-Al-0 124 862, DE-OS No. 26 23 229, U.S. Pat. No. 4,391,845) to substitute the spacing foil by spacers applied directly on the baseboard in the form of insulating layers applied by printing, such as screen printing, or in the form of spacer elements bonded on the baseboard.

However, the application of spacers by printing or bonding has the following disadvantages: An additional working step is required involving not only the expensive setting up of a screen printing machine but also drying and curing periods. Moreover, in screen printing it cannot always be assured that layers of sufficient thickness will result.

It is, therefore, an object of the invention to improve the diaphragm keyboard of the kind specified initially such that it will function very reliably in spite of being given a simpler structure.

The reliable operation is obtained in that faulty contacts are avoided and the individual structural members of the diaphragm keyboard can no longer slip with respect to one another. Furthermore, the diaphragm keyboard is to be easy to manufacture and assemble.

The above object is met in that the encoding plate comprises apertures which are located laterally next to the switch contact surfaces and through which extend pins of electrically non-conductive material, and that the pins stretch from the baseboard to the diaphragm, protruding beyond the surface of the encoding plate.

Advantageous modifications and further developments of the invention may be gathered from the subclaims.

Figure 2:
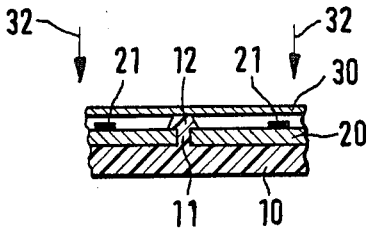
Figure 3:
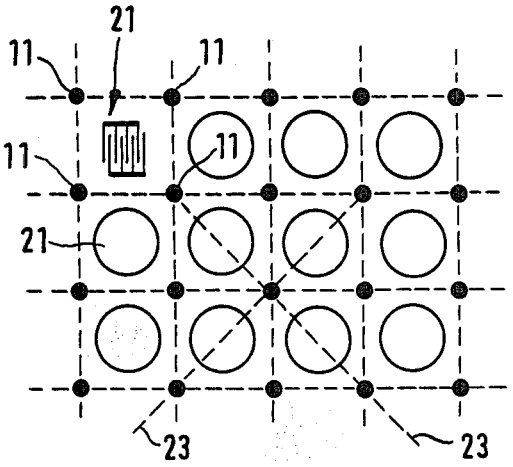
Figure 4:
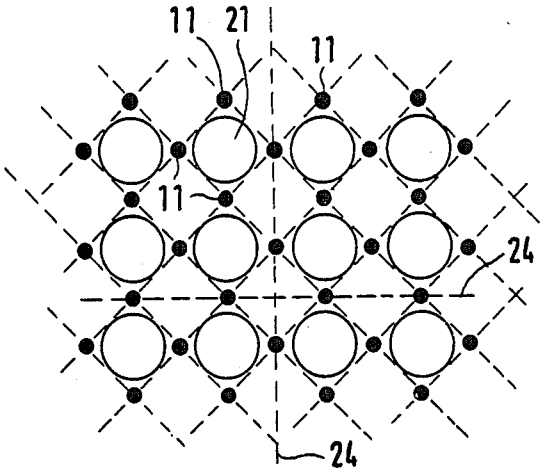
Figure 5:
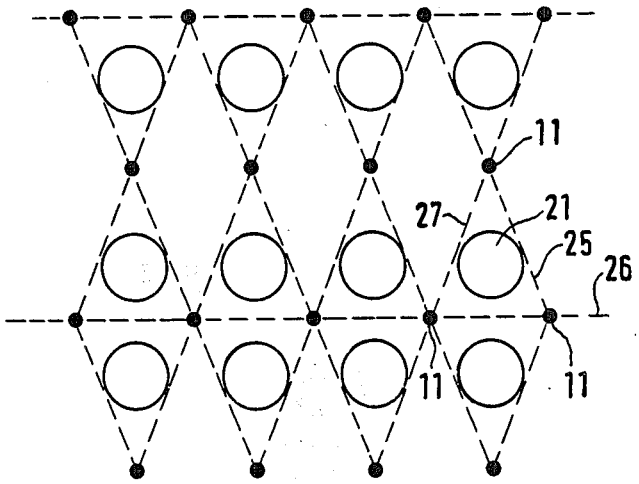
Figure 6:
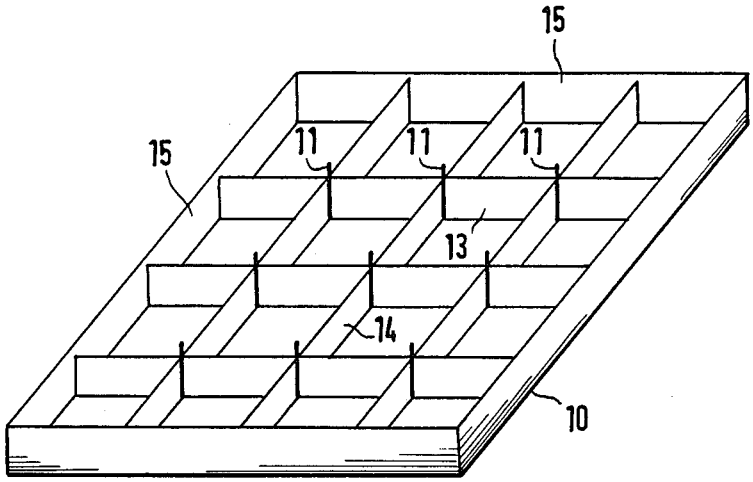

The invention will be described further, by way of example, with reference to the accompanying drawings, in which:

FIG. 1 is a cross sectional view of a diaphragm keyboard according to the invention, FIG. 2 is a sectional detail view of a further development according to the invention, FIGS. 3, 4, and 5 are top plan views of the diaphragm keyboard, with the diaphragm left out to show the arrangement of the pins, FIG. 6 is a perspective view of a variant of the baseboard used according to the invention.

The diaphragm keyboard shown in FIG. 1 consists of no more than three basic components, namely a baseboard 10, an encoding plate 20, and a diaphragm 30. The baseboard 10 which also may be, for instance, the casing of an electromechanical operative group, such as the casing of a remote control transmitter for television sets, the casing of a pocket calculator, or the casing of the dialing keyboard of telephones, is made of plastic material for example. It comprises pins 11 which project vertically from the bottom of the baseboard. Preferably these pins are connected integrally with the baseboard. Yet the pins also may be made as separate members which are then mounted by bonding, inserting, screwing, riveting, or the like. In cross section the pins 11 may be circular, square, rectangular, triangular, or of any other shape.

In the embodiment shown in FIG. 1 the baseboard 10 has sidewalls 15 the upper end face of which lies in the same plane as the upper end faces of the pins 11. Moreover, these sidewalls 15 have an enlarged portion 17 at their upper end, and the thickened portion 17 is formed with a chamfer 16 inclined inwardly, i.e. towards the sidewall at the opposite side.

The diaphragm keyboard further comprises an encoding plate 20 which includes switch contact surfaces 21 and conductor paths (not shown). The switch contact surfaces are of conventional design, for instance in correspondence with the switch contact surfaces according to U.S. Pat. Nos. 4,365,130 or 4,391,845. The encoding plate 20 itself is made of electrically insulating material. It may also consist of a thin, flexible foil. The switch contact surfaces and conductor paths are made in conventional manner, such as by etching or printing and consist of an electrically conductive material. The encoding plate 20 has a plurality of apertures 22 which are arranged in such manner that one of the pins 11 each extends through each aperture. The encoding plate 20 is assembled with the baseboard 10 such that its bottom surface lies flush on the bottom of the baseboard. The pins 11 assure that the encoding plate is secured against any lateral slipping. Thus it is likewise centered with respect to the baseboard.

The third structural member is the diaphragm 30 which consists of elastic material and is electrically conductive at its bottom side at least opposite the switch contact surfaces 21. In the case of the instant embodiment of the invention the diaphragm is electrically conductive throughout its bottom surface, for instance by being coated with conductive varnish. The diaphragm 30 rests on the upper end faces of the pins 11 and on the edges of the sidewalls 15. The length of the pins 11 is selected such that the pins protrude above the encoding plate 20 to such an extent that they will keep the diaphragm spaced above the switch contact surfaces by a distance which, on the one hand, will prevent undesired collisions between the diaphragm and the switch contact surfaces 21 during any mechanical vibration and, on the other hand, will permit the diaphragm 30 to touch the switch contact surfaces 21 of the selected switch contact under pressure exerted by a finger in the direction of arrows 32 at selected "switching points", thus establishing an electrical connection.

The thickened portion 17 of the sidewalls 15 together with the chamfering 16 acts like a snap-action closure preventing the encoding plate 20 from falling out.

As a further safety means, the encoding plate 20 may be bonded to the baseboard 10, particularly in the area of the pins 11. In other words, an adhesive may be provided between the inner diameter of the apertures 22 and the outer diameter of the pins 11.

In accordance with the further development of the invention shown in FIG. 2 the pins 11 may be formed with a thickened head 12 by hot upsetting or ultrasonic welding. In this manner the encoding plate 20 is secured in form lock in the range of the pins as well and cannot fall out. In manufacturing the baseboard in this case attention must be paid that the length of the pins 11 is sufficient so that even with the shortening caused by the hot upsetting there still will be sufficient spacing between the bottom surface 31 of the diaphragm 30 and the switch contact surfaces 21.

FIGS. 3, 4, and 5 show various possibilities of arranging the pins 11 (and the apertures 22) with respect to the switch contact surfaces 21. In these figures the switch contact surfaces are illustrated simply as circles. However, it should be pointed out that the switch contact surfaces may have any desired known configuration.

As shown in FIGS. 3 and 4, a "four point support" is provided. This means that the diaphragm is supported by four pins with respect to each switch contact surface 21. Since the switch contact surfaces 21 in FIGS. 3 and 4 are disposed at uniform spacings in rows and columns, the pins 11 of both these embodiments may be arranged in axial symmetry with reference to the center of the switch contact surfaces. This means that they are located in a circle the center of which, at the same time, is the center of the switch contact surface.

In the case of the embodiment according to FIG. 3 the pins 11 are located at the intersections of diagonal lines 23 which interconnect the centers of diagonally adjacent switch contact surfaces 21. Thus the pins 11 disposed around a switch contact surface 21 forms a square, based on the order of the switch contact surfaces 21 in rows and columns.

The embodiment according to FIG. 4 likewise is one of "four point support". Yet the various pins 11 lie on straight lines 24 which connect the centers of the switch contact surfaces 21 in rows and columns. Furthermore, the pins 11 are located on these lines such that they each are positioned exactly in the middle between two adjacent switch contact surfaces. The pins surrounding a switch contact surface, therefore, again describe a square. This square, however, is rotated through 45° with respect to the square according to FIG. 3.

FIG. 5 illustrates a "three point support". In other words, the diaphragm is supported by three pins 11 only per switch contact surface 21. The pins thus present a triangle with respect to the associated switch contact surface 21. If the spacing between switch contact surfaces 21 in the direction of the rows and columns is the same, the resulting triangles are equilateral, the center of the switch contact surfaces lying in the center of gravity of the surface of the triangle.

However, if the spacing varies in the direction of the rows from that in the direction of the columns, as shown in FIG. 5, isosceles triangles are formed, as indicated by lines 25, 26, and 27. Furthermore, the pins 11 lie on lines 26 which extend in the direction of the rows exactly in the middle between two adjacent rows each of switch contact surfaces.

FIG. 6 shows a further development of the baseboard 10. This baseboard is stiffened by webs 13 and 14 projecting vertically upwardly from the bottom of the baseboard. At the intersections of the webs 13 and 14 a pin 11 each projects upwardly. The encoding plate in this case rests only on the upper end faces of the webs. In a manner similar to FIG. 1, the sidewalls 15 are extended upwardly so that their upper end faces lie in the same plane as the upper end faces of the pins 11. The diaphragm again is supported on the pins 11 and on the upper end faces of the sidewalls 15.

What is claimed is:

1. A diaphragm keyboard having a baseboard, an encoding plate arranged on top of the baseboard and including electrical switch contact surfaces, and a flexible diaphragm which is arranged spaced from and opposed to the encoding plate and includes electrically conductive areas at least opposite the electrical switch contact surfaces wherein the encoding plate comprises apertures which are located laterally next to the switch contact surfaces and through which extend pins of electrically non-conductive material, wherein the pins stretch from the baseboard to the diaphragm, protruding beyond the encoding plate, and wherein said pins serve as spacers holding said diaphragm is a spaced-apart relationship with respect to said encoding plate.

2. The diaphragm keyboard as claimed in claim 1 wherein the diaphragm is made of homogeneous, electrically conductive material.

3. The diaphragm keyboard as claimed in claim 1 wherein the pins (11) have upper and lower end faces and sidewalls (15) of the baseboard (10) have an upper end face, said end face being in a plane with the upper end faces of the pins (11).

4. The diaphragm keyboard as claimed in claim 3 wherein the sidewalls of the baseboard have a thickened head formed with a chamber which is inclined inwardly towards the sidewall at an opposite side.

5. The diaphragm keyboard as claimed in claim 1 wherein the pins are joined integrally with the baseboard.

6. The diaphragm keyboard as claimed in claim 5 wherein each pin has a thickened head which laterally overlaps the containing said pin aperture.

7. The diaphragm keyboard as claimed in claim 6 wherein the apertures and the pins are disposed axially symmetrically with respect to the switch contact surfaces.

8. The diaphragm keyboard as claimed in claim 5 wherein the apertures and the pins are disposed axially symmetrically with respect to the switch contact surfaces.

9. The diaphragm keyboard as claimed in claim 8 wherein the apertures and pins are arranged in a uniform matrix such that they lie on intersections of diagonals which contact adjacent switch contact surfaces.

10. The diaphragm keyboard as claimed in claim 8 wherein the apertures and pins are arranged in a uniform matrix such that they lie on straight lines which connect the switch contact surfaces in rows and columns, the apertures and pins furthermore being uniformly spaced from centers of respective next adjacent switch contact surfaces.

11. The diaphragm keyboard as claimed in claim 5 wherein adhesive material is provided between the inner diameter of the apertures and the outer diameter of the pins.

12. The diaphragm keyboard as claimed in claim 11 wherein the apertures and the pins are disposed axially symmetrically with respect to the switch contact surfaces.

13. The diaphragm keyboard as claimed in claim 11 wherein the apertures and pins are arranged around respective switch contact surfaces such that connecting lines form a triangle in which is located a center of a corresponding switch contact surface.

14. The diaphragm keyboard as claimed in claim 13 wherein the baseboard comprises webs which project vertically from its bottom, pins each protruding above an upper edge of the webs at intersections of the webs.

15. The diaphragm keyboard as claimed in claim 14 wherein the diaphragm is electrically conductive at its entire bottom surface.

* * * * *